US011123624B2

(12) United States Patent
Resnicke et al.

(10) Patent No.: US 11,123,624 B2
(45) Date of Patent: Sep. 21, 2021

(54) CLIMBING WALL CONSTRUCTION COMPONENTS, SYSTEM AND METHOD

(71) Applicant: HIGH VELOCITY DESIGNS, LLC, Newcastle, CA (US)

(72) Inventors: Christopher Ryan Resnicke, Lincoln, CA (US); Jeffrey Dean Wilson, Newcastle, CA (US); Vernon Vernaza, Antelope, CA (US)

( * ) Notice: Subject to any disclaimer, the term of this patent is extended or adjusted under 35 U.S.C. 154(b) by 79 days.

(21) Appl. No.: 16/000,455

(22) Filed: Jun. 5, 2018

(65) Prior Publication Data

US 2018/0353823 A1 Dec. 13, 2018

Related U.S. Application Data

(60) Provisional application No. 62/516,313, filed on Jun. 7, 2017.

(51) Int. Cl.
*A63B 69/00* (2006.01)

(52) U.S. Cl.
CPC ..... *A63B 69/0048* (2013.01); *A63B 2208/12* (2013.01); *A63B 2225/09* (2013.01)

(58) Field of Classification Search
CPC ..... A63B 69/0048; A63B 2208/12; A63B 2225/09
See application file for complete search history.

(56) References Cited

U.S. PATENT DOCUMENTS 5,125,877 A 1/1992 Brewer
5,254,058 A * 10/1993 Savigny ..... A63B 69/0048 482/35
5,543,185 A * 8/1996 Christensen ..... A63B 69/0048 156/61
6,083,142 A 7/2000 Wilson
6,390,952 B1 5/2002 Wilson
6,402,663 B1 6/2002 Popp
6,659,496 B1 12/2003 Wilson
7,056,266 B2 6/2006 Sudeith
7,182,695 B1 2/2007 Tostenson et al.
7,572,207 B2 8/2009 Postma
9,545,555 B2 1/2017 Sudeith et al.
2002/0019297 A1* 2/2002 Vettori ..... A63B 69/0048 482/37
2002/0022552 A1* 2/2002 Yoshida ..... A63B 69/0048 482/37
2006/0258511 A1* 11/2006 Postma ..... A63B 69/0048 482/35
2008/0032863 A1 2/2008 Delsing
2012/0046145 A1 2/2012 Barriuso Oses

OTHER PUBLICATIONS

Emily Whiting, Environment-Scale Fabrication: Replicating Outdoor Climbing Experiences, Jun. 6, 2017, pp. 1-11.

* cited by examiner

*Primary Examiner* — Sundhara M Ganesan
(74) *Attorney, Agent, or Firm* — Pate Baird, PLLC

(57) ABSTRACT

A climbing wall may be constructed using a variety of techniques and components. The climbing wall may be comprised of a number of dihedral angles. The individual panels of the wall may include a curve along the edge of the panel, with a corresponding slope cut along the edge, which enables a wider variety of dihedral angles to be formed utilizing the panels.

12 Claims, 12 Drawing Sheets

CLIMBING WALL CONSTRUCTION COMPONENTS, SYSTEM AND METHOD

RELATED APPLICATIONS

The application claims the benefit of U.S. Provisional Patent Application Ser. No. 62/516,313 filed on Jun. 7, 2017, which is hereby incorporated by reference in its entirety.

BACKGROUND

Field of Invention

The invention relates to a climbing wall, or traversing wall, and more particularly to components and a system and method for construction of such a wall.

Background

Climbing, or rock climbing, as an activity can have numerous benefits. Many people enjoy rock climbing as a hobby or sport. Rock climbing can also improve physical abilities, cognitive skills, and social interaction skills.

Climbing walls can provide a safe yet challenging opportunity to practice numerous rock climbing skills and techniques. Climbing walls can come in a wide variety of shapes, sizes, and degrees of difficulty. Climbing walls can be designed to simulate an actual rock formation or to provide for practicing a particular rock climbing technique. Climbing walls can be designed for everyone from beginning climbers to advanced climbers, and small children to experienced adults.

Building a climbing wall can provide its own set of challenges. Designing a climbing wall with multiple and various angles of pitch and surface areas can be difficult and time consuming. The surface of a climbing wall can be made to appear and feel as close to an actual rock formation as possible.

Generally, a climbing wall is an artificially constructed wall that may be used to practice rock climbing, or similar climbing activities. A climbing wall may be located indoors or outdoors. A climbing wall often includes grips or pegs that may be utilized by the hands and feet of users or climbers.

Various materials may be used for the construction of climbing walls. Similarly, various support structures may be used to support or frame a climbing wall. For example, plywood, or similar construction materials, may be used to construct the climbing surface of a climbing wall. The panels may be attached to a frame or other support structure.

When panels are used to construct a climbing wall, the panels can be difficult to fit together in a strong, precise manner.

It would be an improvement in the art to provide specific components and a corresponding method for constructing a climbing wall, or traversing wall, that enables the panels used to fit together at precise angles and in a secure, strong manner.

It would also be an improvement in the art to provide specific components and a corresponding method of constructing a climbing wall, or traversing wall, that enables a virtually limitless combination of angles, shapes, and sizes of panels to be fit together in any specified, designed manner.

It would be an advance in the art of building climbing walls to provide a system that can account for all the panels and angles that are required in the building of a climbing wall. It would also be an advance in the art to engineer component parts that can be manufactured or fabricated using similar structures and formations, but still allow for a wide variety of dihedral angles and surface areas while still providing tight, smooth seams between panels.

BRIEF SUMMARY OF THE INVENTION

In accordance with the foregoing, certain embodiments of a product, formation, system and method of use in accordance with the invention provide a system and components that can be used to design and construct a climbing wall, or similar structure. Such a climbing wall can provide a safe and convenient place for rock climbing activities, or the like.

A system or method for building a climbing wall may include selecting an area where a climbing wall is desired and appropriate. Selecting an appropriate area may include considerations such as the size of the wall, whether it will be indoors or outdoors, safety considerations related traffic around the wall and accommodations for safety equipment, as well as other considerations.

A system or method for building a climbing wall may include designing the wall in a particular manner. Designing a climbing wall may include considerations such as the size and dimensions of the wall, the desired contours and features of the wall, the individual component parts or pieces needed, as well as other considerations. Designing a climbing wall may include mapping the component parts in a way that illustrates where and how each component will be placed and assembled. Mapping may also including producing a drawing or illustration that can be used to organize and execute the assembly and construction of the climbing wall.

A system or method for building a climbing wall may include fabricating the component parts and pieces needed to construct or assemble the intended climbing wall. The fabrication of such component parts may include considerations such as the size and shape of each component, the angles in relation to the respective components, and the placement and use of each component part.

The fabrication of such component parts may also include fabricating certain components in a manner that enables assembly with a wide variety of angles, but still allows the components to be fabricated or manufactured in a similar, consistent manner. For example, and not by way of limitation, edges of component panels may include a means for allowing respective panels to be joined at the edges at a wide variety of angles, such as by the use of a curved edge to a panel that is also cut or sloped in a way to allow the respective edges to be rotated near each other without abutting into each other in a manner that maintains the desired angle and produces a relatively smooth, virtually seamless, joint.

The fabrication of such component parts may also include fabricating components that help to maintain and hold an angle between two panels. For example, and not by way of limitation, an angle lock component may be fabricated in such a manner that it can be used to align two panels at a desired angle. In one embodiment, multiple dihedral angles may be formed and utilized in a climbing wall.

A system or method for building a climbing wall may include identifying the components in a manner that facilitates assembly of the component parts and pieces. For example, and not by way of limitation, panel components may include alpha-numeric designations that help in the placement and alignment of the panels, and angle lock components may include similar alpha-numeric designations that help in the placement of panels and the formation of desired angles.

A system or method for building a climbing wall may include building a scaffold or support structure. A support scaffold may be utilized to provide a structure that can help during the joining and assembly of the component parts, as well as providing support and stability for a finished climbing wall. A support scaffold can be of virtually any size and configuration.

A system or method for building a climbing wall may include assembling and constructing the climbing wall in accordance with the design and mapping developed early in the process. Assembling a climbing wall may include considerations such as the tools to be used, the attachment and adhesion techniques to be utilized, and time required to complete assembly or construction, as well as other considerations. Assembling the climbing wall may be accomplished in any suitable manner using the design or map, the component parts and pieces, appropriate tools and materials, and any other suitable components, materials or techniques.

A system or method for building a climbing wall may include finishing the wall in any suitable manner. Finishing a climbing wall may include considerations such as a desired texture for the wall, placement of holds or pegs on the surface of the wall, and installation of safety equipment in association with the wall, as well as other considerations.

In one embodiment, a climbing wall, or traversing wall, may include a support frame, or steel sub-structure, or similar structure, that serves as a foundation for the wall. A support frame may usually include a frame surface, or "neutral plane," that is substantially parallel to the intended or planned climbing wall surface.

A support frame may be composed of any suitable material and may be constructed in any suitable shape. Generally, the shape of a support frame may be rectangular, but other shapes are possible.

In one embodiment, one panel will be placed at a time, measuring each panel corner to make sure it is the appropriate distance from a "neutral plane". The neutral plane may be defined by the installer on site, and is generally parallel to the front of the steel sub-structure, generally approximately 4.5" away. FIG. 11 (described more herein below) provides an example of a document that may be used on a site to help with construction of the wall. Each piece is constructed such that it should self-align, but having the installer double check these distances prevents misalignment of the whole wall (prevents the installer from accidentally leaning it forward, installing the left side further out than the right, etc.).

To place a panel, the installer may start by installing the angle locks into one or more of the adjacent panels that have already been placed. Then they lift the panel they want to install into position and fit it onto those angle locks. This may be done by hand as much as possible, but often results in a very tight fit. To make sure the panels are perfectly angled, the installer will screw on L-brackets, or a lock brace, connecting the angle locks to the panel, ensuring that the panels are flush against the angle lock alignment faces, or anterior surfaces. Since the alignment faces on the angle locks are CNC features, and multiple angle locks are used to connect each edge, the result is a minuscule amount of error in the resulting angle between the panels.

The angle locks may fit into CNC (computer numerical control) router cut-outs, or grooves, on the back of each panel, and are self-symmetrical so it is impossible to install them "backward." An angle lock marked or identified "1-2" may be intended to connect panels 1 and 2. The tabs on the angle lock are designed to have a tiny amount of flex, allowing them to be more easily installed. Because these are all generally made of wood, there is some variability in the same piece of material based on things like humidity and temperature. This small amount of flex allows the angle locks to be installed even if the panel wood is swollen. Additionally, it accommodates the small amount of inaccuracy from the CNC when it is creating the features on the various parts.

The panels are designed such that each panel may consist of the same features repeated. The CNC cut-outs, or grooves, may be shaped like an "H" because this allows those features to be cut with the same CNC tool as the holes for the climbing hand-holds. By putting in those extra rounds, the angle lock's sharp edges won't interfere with the panel material. This allows them to interact with greater accuracy, since the angle lock's flat edges can be easily aligned with the internal flat edges of the cut-out.

Also, because of the way the angle locks interact with the "H" cut-outs, any force that would try to pull the panel toward the climber causes the angle locks to pivot slightly about the joint it is connecting. This means that the angle locks on the left side of a panel pivot left, and the ones on the right side of a panel pivot right. Much like a "Chinese finger trap" the harder you pull, the harder the angle locks hold on. During deconstruction of a prototype wall, the panels had to be broken to be removed, even after removing every other fastening feature.

Each panel may be numbered to make on-site assembly simple. As has been previously mentioned, this also makes the angle locks easy to identify, since panels 1 and 2 are connected by angle lock 1-2. In certain embodiments, one may see panels numbered things like "17A" and "17B." Not every final panel can be easily cut out on a CNC table in a single piece. So, the panels are subdivided into A, B, C, etc. parts so that the woodworker knows to splice all the "17_" pieces together to form panel 17. This system allows each panel to be readily identified. Without these numbers, the on-site assembler and wood workers would just be looking at a pile of generic triangular panels, trying to figure out which goes where.

The "universal edges" on the panel are critical to the overall functionality. The fillet or curve on the front end accomplishes at least 2 tasks: it allows the panel to be placed at different angles without greatly effecting the interference between panels that angle out toward the climber (this interference changes on the order of 0.01"), and it maintains a clean aesthetic. The bevel or slope cut on the back also accomplishes at least 2 tasks: it allows the panels to be angled away from the climber at up to 60 degrees without effecting panel interference at all, and it creates a long channel on the back of the wall that can then be filled with adhesive. Since this channel is about one-half inch deep and often several feet long, it creates a huge amount of useful surface area to adhere to that can be accessed at the very end of installation. Even if a relatively weak adhesive is used, the result is an extremely strong joint. For example, a 6' long edge with a 50 psi adhesive can hold 1800 lbs of tension even if the mechanical fasteners are ignored, it is not uncommon for wood glues to be in the 3000-4000 psi range. This is all accomplished with a consistent edge profile, meaning a CNC cutting tool can be made to create this edge automatically in a single pass.

The interaction between the angle lock, "H" cut-outs, and the universal edge can be very important. The angle locks and "H" cut-outs set the spacing accurately on the order of 0.01". The universal edge makes edges appear clean and relatively smooth regardless of the angle the panels meet at, or dihedral angle, in part because the point where the bevel and fillet meet is the same point that the angle locks and "H" cut-outs use as their reference.

To hold the climbing surface to the frame, or scaffold, a system of wood brackets may be used and installed on site, unistrut, existing L brackets, and the holes on the standard framing. This allows the installer to align things easily, as each piece can be adjusted to accommodate the panel angle and any site-specific complications.

Overall, the panels can be cut entirely on a CNC router with only a single tool change. This results in very fast, efficient, and inexpensive manufacturing. It also results in a very accurately laid out wall, which allows for very interesting possibilities. Using this same technique or method, a wall could be built to replicate existing climbing routes.

In one embodiment, a route may be 3D scanned and could be replicated, for example, where the shape of the rock face is part of the challenge. In addition to re-creating individual handholds or footholds, a particular rock face could be replicated generally or exactly. The general shape could be approximated by the existing method. The exact rock face could be produced by mounting a 3D CNC carved or 3D printed piece onto the front of panels described herein. Thus, in one embodiment, existing panels could provide a rough base that approximated the general route shape, and the 3D carved piece could provide the rest of the detail.

BRIEF DESCRIPTION OF THE DRAWINGS

The foregoing features of the present invention will become more fully apparent from the following description and appended claims, taken in conjunction with the accompanying drawings and data. Understanding that these drawings and data depict only typical embodiments of the invention and are, therefore, not to be considered limiting of its scope, the invention will be described with additional specificity and detail through use of the accompanying drawings and data in which:

DETAILED DESCRIPTION OF THE PREFERRED EMBODIMENTS

It will be readily understood that the components of the present invention, as generally described herein, could be arranged and designed in a wide variety of different configurations or formations. Thus, the following more detailed description of the embodiments of the system, components, product and method of the present invention, is not intended to limit the scope of the invention, as claimed, but is merely representative of various embodiments of the invention.

A climbing wall may be formed or constructed in a wide variety of formations and sizes. A climbing wall may consist of numerous dihedral angles designed to make the climbing wall appear more like a natural rock formation.

Figure 1:
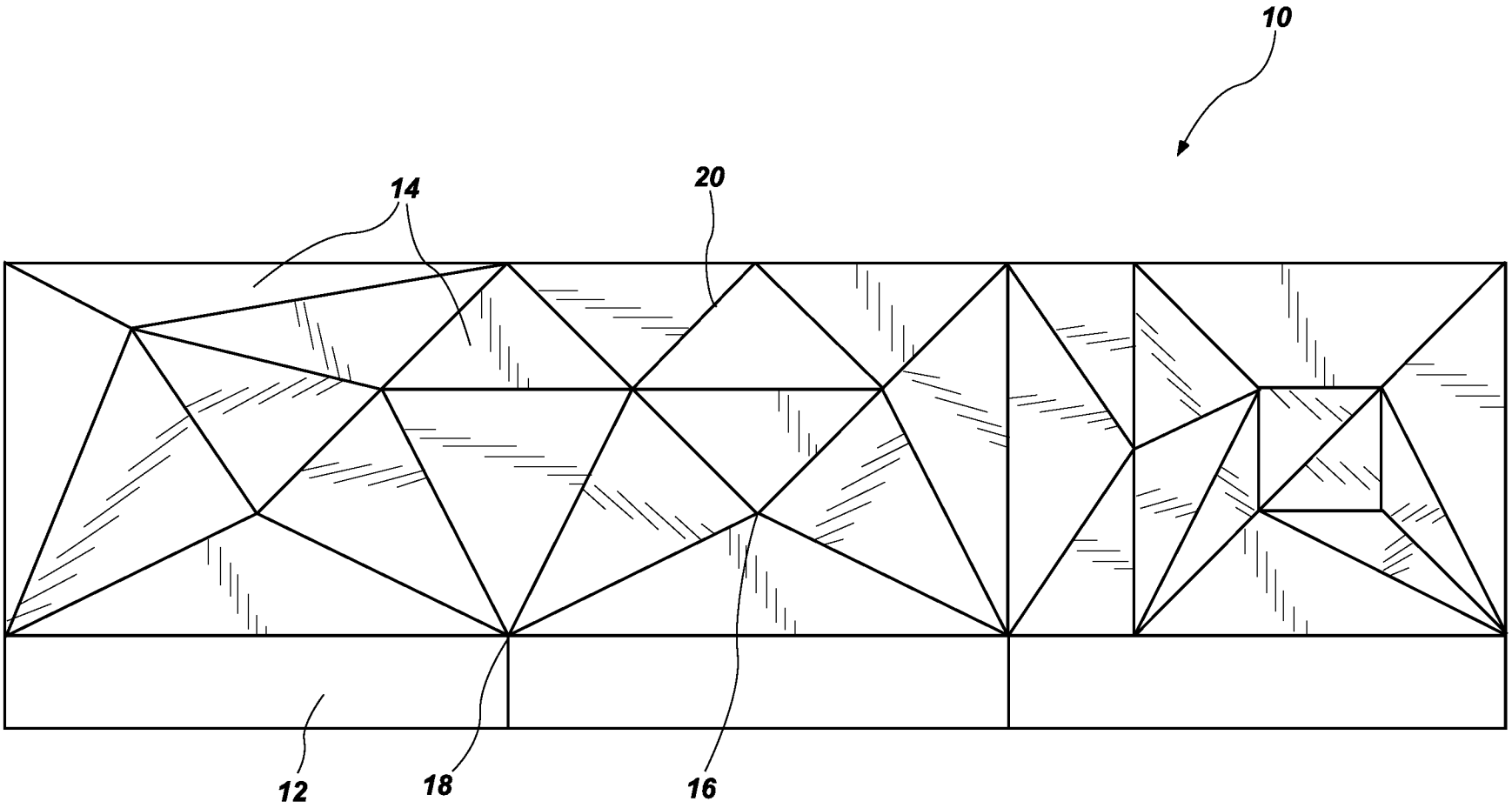
FIG. 1 is a front view of a climbing wall with shading showing contours.

Referring to FIG. 1, a climbing wall 10, or wall 10, may be comprised of a plurality of individual panels 14. In one embodiment, a base panel 12 may be utilized to provide a base or foundation for the wall 10. Each panel 14 may be located in a specific position and at a given angle with respect to adjacent panels 14. Two or more adjacent panels 14 may be joined at obtuse angles to produce an apex 16, or peak 16, along the surface of the wall 10. Two or more adjacent panels 14 may be joined at reflex angles to produce a depression 18, or nadir 18, along the surface of the wall 10. Panels 14 may be joined at virtually angle to produce an apex 16 or a depression 18 along the wall. Generally, the angle between two intersecting panels 14 may be referred to as a dihedral angle. Two or more adjacent panels 14 may be joined along a joint 20, or seam 20, to produce a dihedral angle.

A panel 14 may be composed of any suitable material, including without limitation, wood, plastic, steel, or the like. A panel 14 may come in a wide variety of shapes, including without limitation, a triangle, a rectangle, a polygon, a circle, an arch, a combination of shapes, or the like. A panel 14 may come in any suitable size and shape as may be needed to provide various contours for the wall 10.

Figure 2:
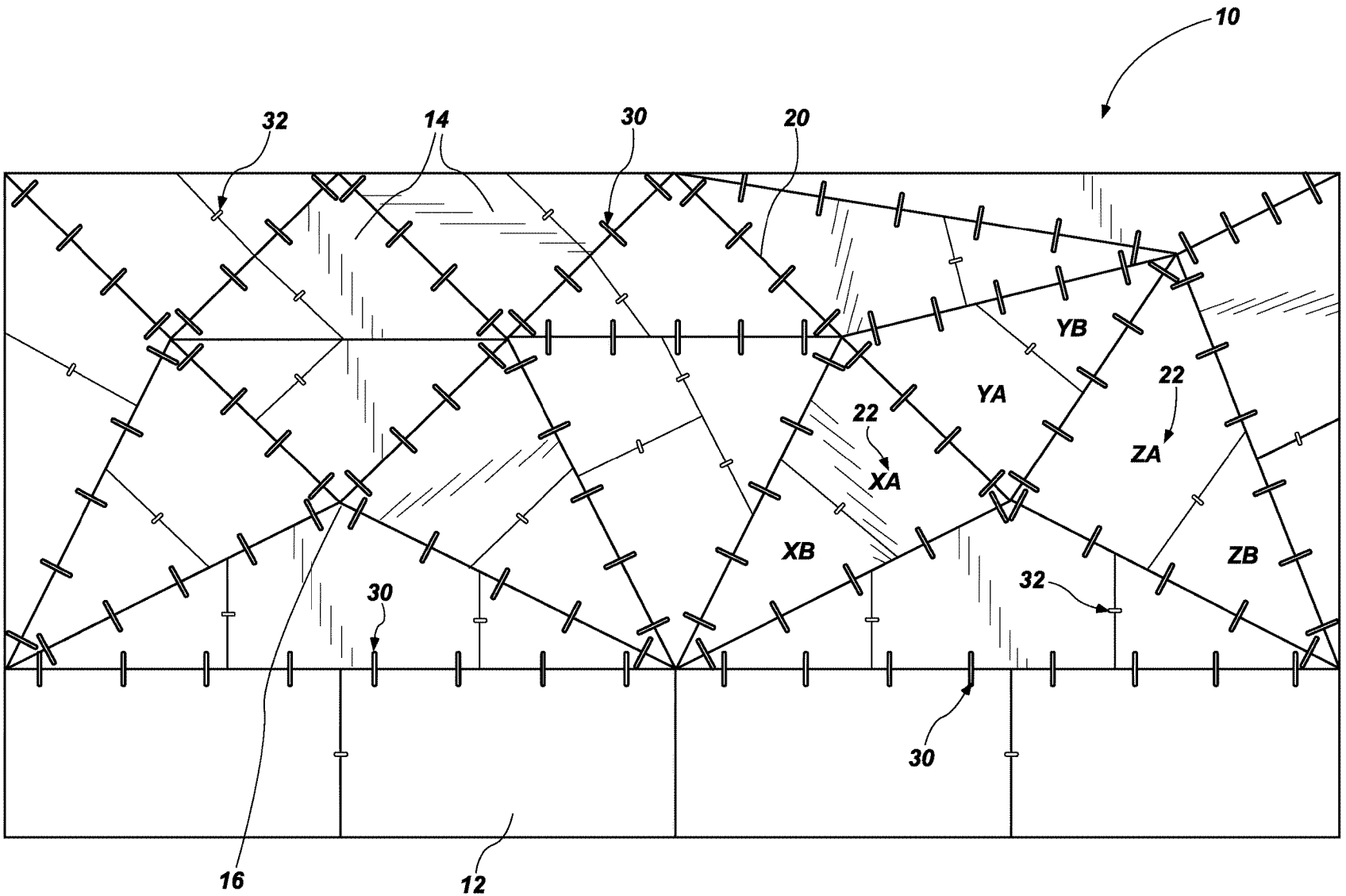
FIG. 2 is a back view of a climbing wall.

Referring to FIG. 2, the back or reverse side of a climbing wall 10 may provide more detail with respect to how the wall 10 may be constructed. Individual panels 14 may include a panel label 22, or a panel designation 22. Such a panel label 22 may be used to help make sure individual panels 14 are properly aligned and positioned during assembly of the wall 10. A panel label 22 may be comprised of any suitable alpha-numeric character.

Individual panels 14 may be joined along a joint 20 and the joint 20 may be supported and/or held in place by an angle lock 30. One or more angle locks 30 may be utilized along a joint 20, or seam 20. A brace 32 may also be utilized along a joint 20 to hold individual panels 14 together. For example, and not by way of limitation, a brace 32 may be utilized to hold and secure two panels 14 along a joint 20 when the panels 14 will be essentially planar with respect to each other, or when the panels 14 will not form a dihedral angle.

Figure 3:
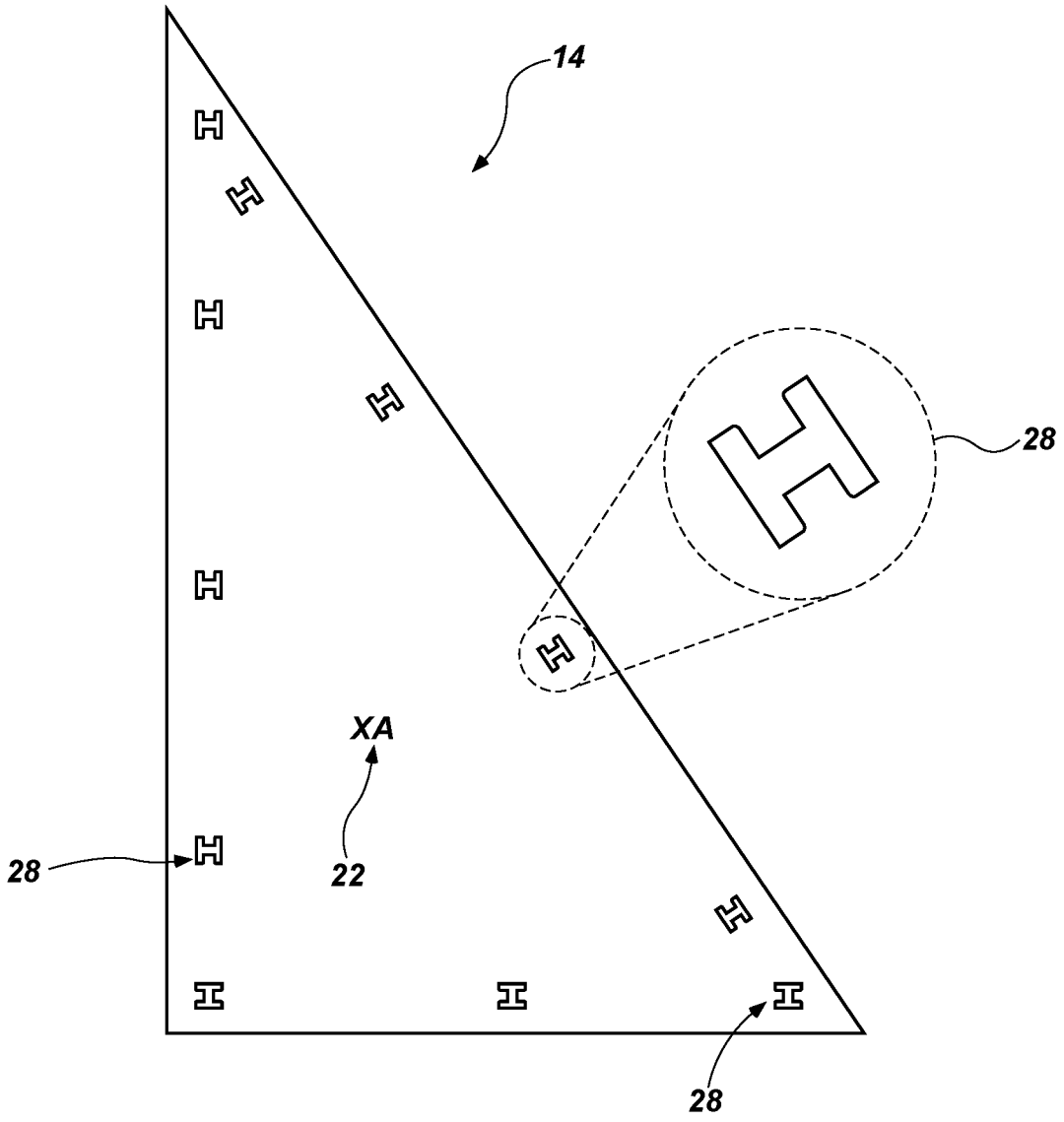
FIG. 3 is a bottom plan view of a panel.

Referring to FIG. 3, a panel 14 may include one or more grooves 28, or notches 28. A groove 28, or notch 28, is cut out of a panel 14 to have a certain depth and to provide a hole for receiving a tab 34. A groove 28 may have an "H" shape, or any suitable shape, and may be positioned along an edge of the panel 14 in any suitable manner. A panel 14 may also include a panel label 22, or a panel designation 22. A panel label 22 may be comprised of any suitable alpha-numeric character.

Figure 4:
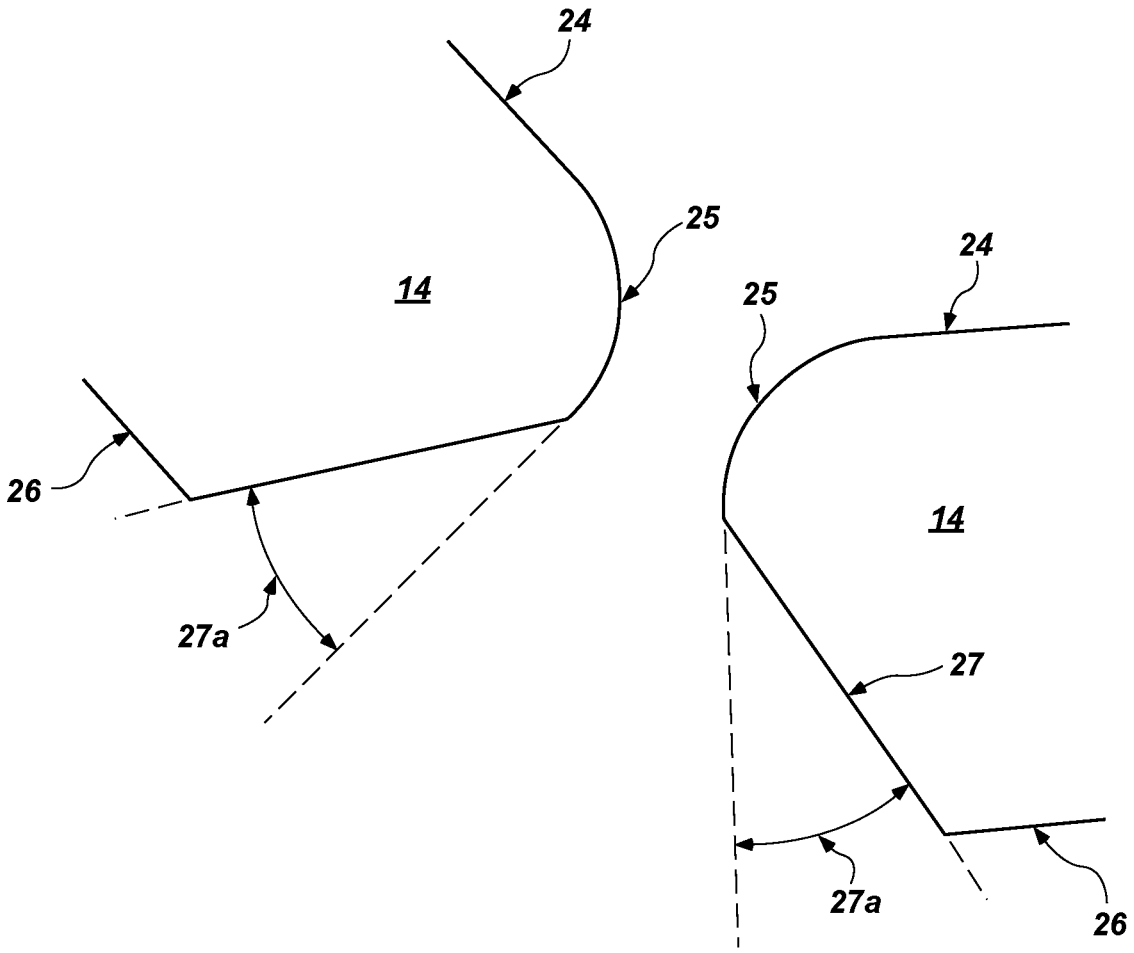
FIG. 4 is a side view of two panels showing a possible joint configuration.

Referring to FIG. 4, a joint 20 or seam 20 may be formed in any suitable manner. In one embodiment, individual panels 14 may include a panel curve 25 along an edge of the panel 14 on the front surface 24, or panel front 24, of the panel 14. A panel 14 may include a slope cut 27, or recess cut 27, along an edge of the panel 14 on the back surface 26, or panel back 26, of the panel 14. A slope cut 27 may produce a slope angle 27*a* with respect to the normal corner or configuration of the edge of the panel 14. Also, a panel curve 25 and a slope cut 27 may be opposite each other along the same edge of a panel 14. A panel 14 may be designed such that each panel 14 may consist of the same features repeated. For example, and not by way of limitation, a panel 14 may include a panel curve 25 and a slope cut 27 along each edge of the panel 14. Put another way, each panel 14 may have a "universal edge" in that the edge may consist of a panel curve 25 and a slope cut 27, thereby making the functionality and process for adjoining panels 14 virtually identical for every panel 14 and every joint 20.

Figure 5:
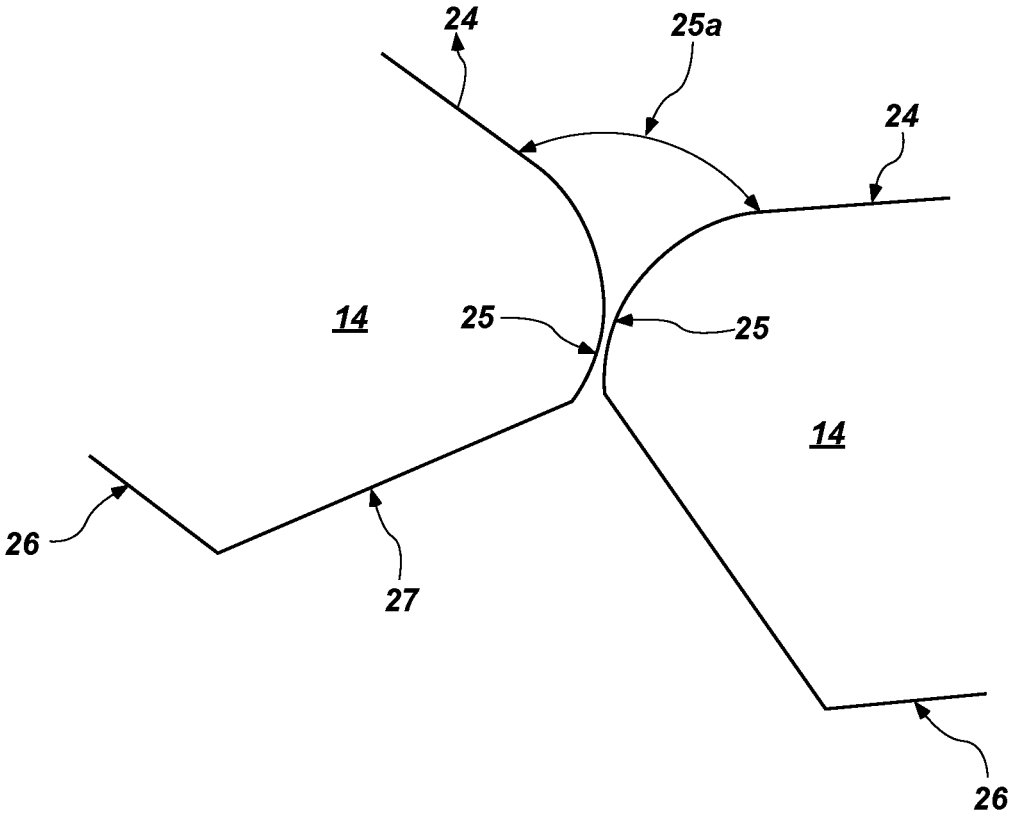
FIG. 5 is a side view of two panels showing a possible joint configuration.

Referring to FIG. 5, a joint 20 or seam 20 may be formed to produce a dihedral angle 25*a*. In one embodiment, individual panels 14 may be joined or abutted against each other at a point on each panel's respective panel curves 25. The respective panel curves 25 allow the panels 14 to be rotated or adjusted next to each other in a manner that allows the production of a wide variety of dihedral angles 25*a*. The respective panel curves 25 also allow the panels 14 to be placed and aligned without greatly effecting the interface between panels that may angle toward a climber. The respective panel curves 25 also allow for a cleaner, smoother joint 20.

For example, and not by way of limitation, two panels 14 may be placed next to each other and one panel's panel curve 25 may contact the other panel's panel curve 25 at any point along the respective panel curves. Then the panels may be rotated in a manner that draws the respective panel fronts 24 toward each other and creates an obtuse angle with respect to the panels' panel fronts 24. This example may be used to create a virtually seamless joint 20, or a seam 20 that is very smooth and has virtually no gap between the panels. This example may be used to create a depression 18, or nadir 18, on the surface of a climbing wall 10.

For example, and not by way of limitation, two panels 14 may be placed next to each other and one panel's panel curve 25 may contact the other panel's panel curve 25 at any point along the respective panel curves. Then the panels may be rotated in manner that draws the respective panel backs 26 toward each other and creates a reflex angle with respect to panels' panel fronts 24. Also, as the panels are rotated in a manner that draws the respective panel backs 26 toward each other, the space between the respective slope cuts 27 of the panels may draw closer in a manner that brings the slope cuts 27 toward each other, even to the point of having the slope cuts 27 contact each other. Generally, a space will be maintained between the respective slope cuts 27 and a channel, or trench, will result, which channel may be filled with adhesive to secure the adjacent panels 14 to each other. This example may be used to create a virtually seamless joint 20, or a seam 20 that is very smooth and has virtually no gap between the panels. This example may be used to create an apex 16, or peak 16, on the surface of a climbing wall 10.

Figure 6A:
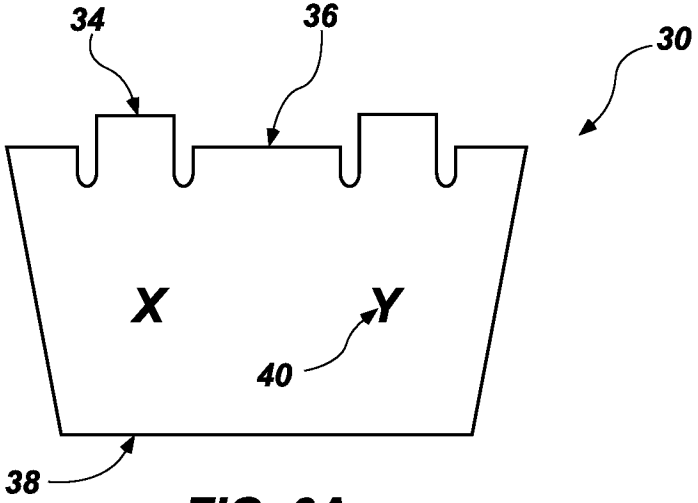
FIG. 6A is a side view of a possible angle lock configuration.
Figure 6C:
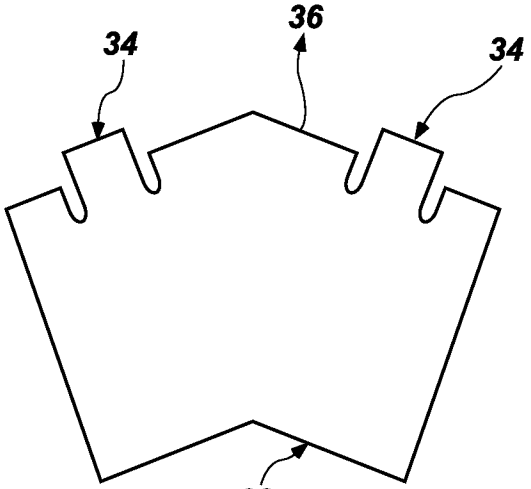
FIG. 6C is a side view of a possible angle lock configuration.
Figure 6B:
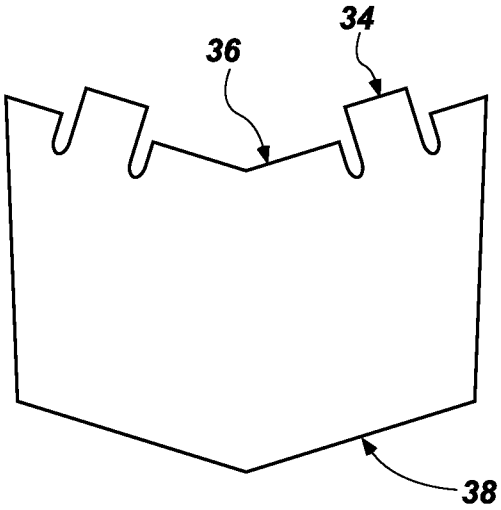
FIG. 6B is a side view of a possible angle lock configuration.

Referring to FIGS. 6A, 6B, and 6C, an angle lock 30 may have a variety of shapes and configurations. Generally, an angle lock 30 is self-symmetrical to make it virtually impossible to install an angle lock 30 backwards. An angle lock 30 may be composed of any suitable material, including without limitation, wood, plastic, steel, or the like. An angle lock 30 may be used to hold two adjacent panels 14 together while supporting the panels 14 at a desired dihedral angle.

In one embodiment, an angle lock 30 may have a tab 34, an anterior surface 36, and a posterior surface 38. As shown in FIG. 6A, an angle lock may have an anterior surface 36 that is essentially level or straight, which may be used when two panels 14 are being aligned or joined together in a substantially planar manner. The tabs 34 of an angle lock 30 may have squared or rounded corners, as may be desired. The tabs 34 of an angle lock 30 may be designed to have a slight amount of flex. The tabs 34 of an angle lock 30 may fit into corresponding grooves 28 along adjacent edges of a panel 14. An angle lock may also include a lock label 40, or an angle lock designation 40, which may be comprised of any alpha-numeric character.

As shown in FIG. 6B, an angle lock 30 may have an anterior surface 36 that is configured to form an obtuse angle. An angle lock 30 having such a configuration may be utilized to support and hold two adjacent panels 14 in a manner that forms an obtuse, dihedral angle with respect to the front surfaces 24 of the panels 14.

As shown in FIG. 6C, an angle lock 30 may have an anterior surface 36 that is configured to form a reflex angle. An angle lock 30 having such a configuration may be utilized to support and hold two adjacent panels 14 in a manner that forms a reflex, dihedral angle with respect to the front surfaces 24 of the panels 14.

Figure 7:
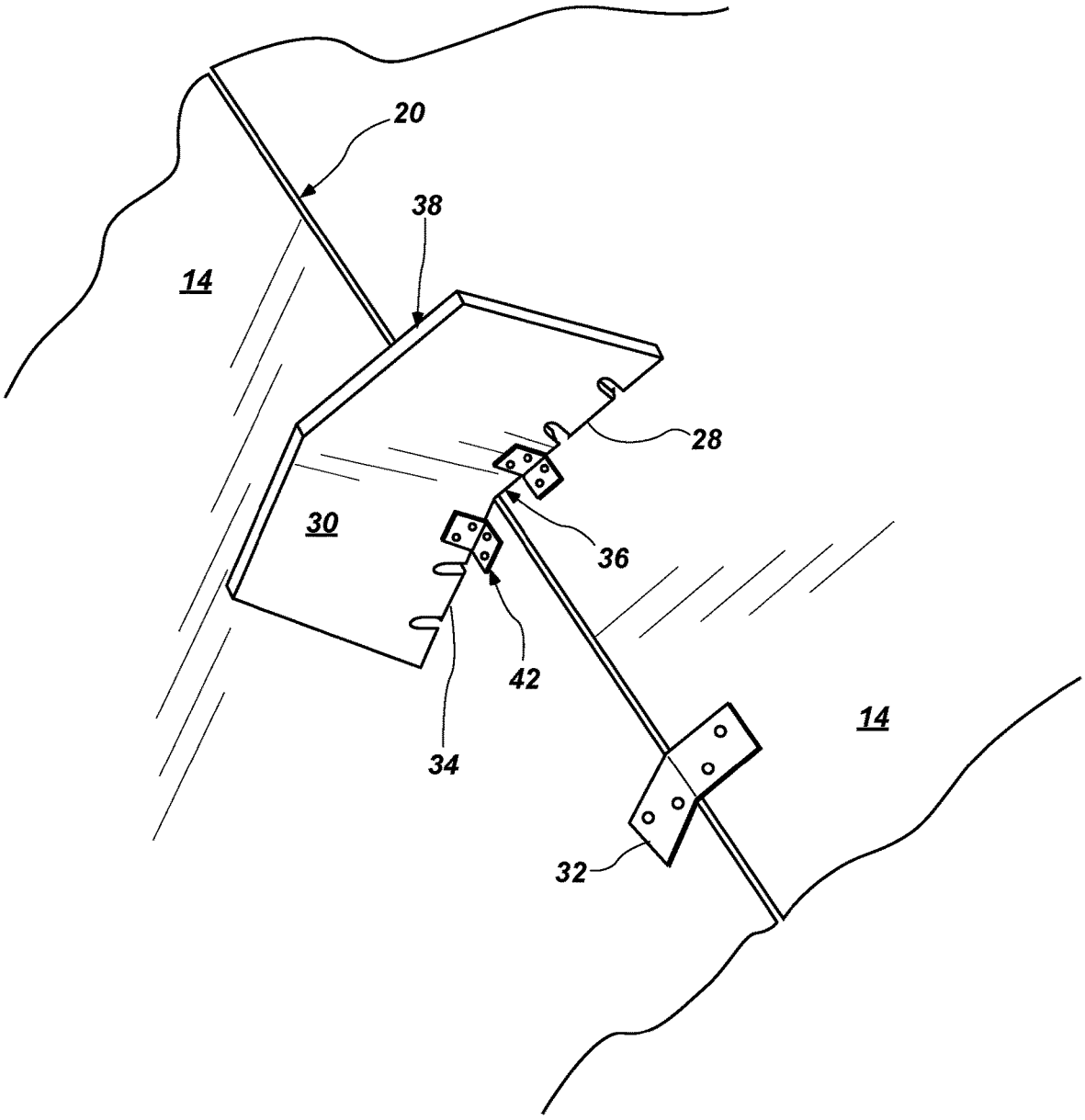
FIG. 7 is a perspective view of a possible joint configuration.

Referring to FIG. 7, two panels 14 may be joined along a joint 20 or seam 20 in any suitable manner. In one embodiment, an angle lock 30 may be utilized to hold two panels 14 in place and support the panels 14 at a desired dihedral angle. The dihedral angle may be defined by the anterior surface 36 of the angle lock 30. The tabs 34 of an angle lock 30 may fit into the corresponding grooves 28 along the edges of adjacent panels 14. The tabs 34 may be held or secured within the grooves 28 by any suitable means, including without limitation, adhesives, friction, nails, screws, or the like.

The angle lock 30 may be secured to the panels 14 in any suitable manner. For example, and not by way of limitation, a lock brace 42 may be used to secure an angle lock 30 to a panel 14. A lock brace 42 may have any configuration desired, including without limitation, an "L" shape that allows the angle lock 30 to be secured to a panel 14 at a substantially right angle. A lock brace 42 may also be utilized to make sure the desired dihedral angle between panels 14 adjoined by the angle lock 30 and secured by the lock brace 42 is correct as much as possible. A lock brace 42 may be secured to an angle lock 30 and to a panel 14 in any suitable manner, including without limitation, by the use of screws, nails, adhesives, or the like.

In one embodiment, the angle locks 30 may interact with the grooves 28, or "H" cut-outs in such a manner that any force that would try to pull the panel 14 toward a climber causes the angle locks 30 to pivot slightly about the joint 20. Thus, the angle lock 30 on the left side of the panel 14 will pivot left, and the angle locks 30 on the right side of a panel 14 will pivot right. The result is that the harder a panel is pulled outwards, or toward a climber, the harder the angle locks 30 will hold, similar to the manner a "Chinese finger trap" holds. This feature may also be described as "self-locking" the panels 14, or put another way, securing the panels 14 utilizing the angle locks 30 in a manner that provides self-locking of the panels 14 if the panels 14 are pulled away from the angle locks 30, or pulled toward a climber.

A brace 32 may be used to further secure adjacent panels 14 to each other. A brace 32 may have any configuration desired, including without limitation, forming an obtuse angle, forming a reflex angle, substantially flat, or the like. For example, a brace 32 may have an angle similar or virtually identical to the angle of an anterior surface 36 of an angle lock 30 that is being utilized in conjunction with or near the brace 32 to further secure the joint 20 of two panels 14.

Figure 8:
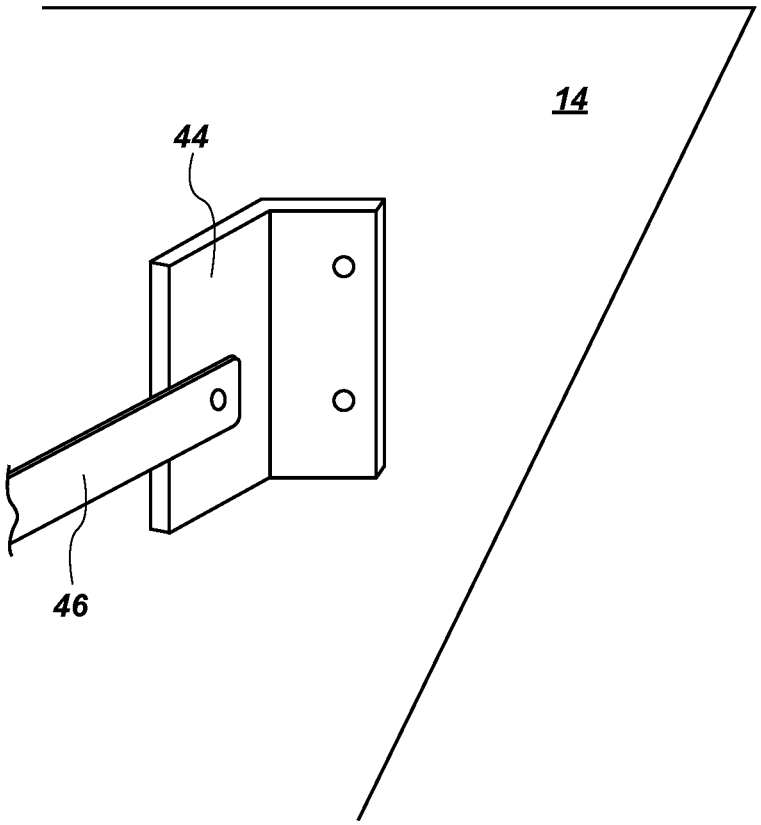
FIG. 8 is a perspective view of a possible scaffold support connection.

Referring to FIG. 8, a panel 14 may be secured to a support scaffold 50, or scaffold 50, in any suitable manner. In one embodiment, a support brace 44 may be secured to a panel 14 and a support arm 46 may be secured to the support brace 44. A support brace 44 may be secured to a panel 14 in any suitable manner, including without limitation, by using screws, nails, adhesives, or the like. A support brace 44 may have any suitable configuration, including without limitation, an "L" shaped configuration that enables securing the support brace 44 to a panel 14 at a substantially right angle. A support arm 46 may have any suitable configuration, including without limitation, a straight configuration. A support arm 46 may be secured to a support brace 44 in any suitable manner, including without limitation, by using bolts, screws, nails, adhesives, or the like. Also, a support arm 46 may be secured to a support brace 44 at virtually any angle that will facilitate securing the support arm 46 to a scaffold 50. Also, a support arm 46 may be secured to a support brace 44 in a manner that allows for rotation or pivoting of the support arm 46 after attachment, thereby allowing for changes in the angle of attachment.

Figure 9:
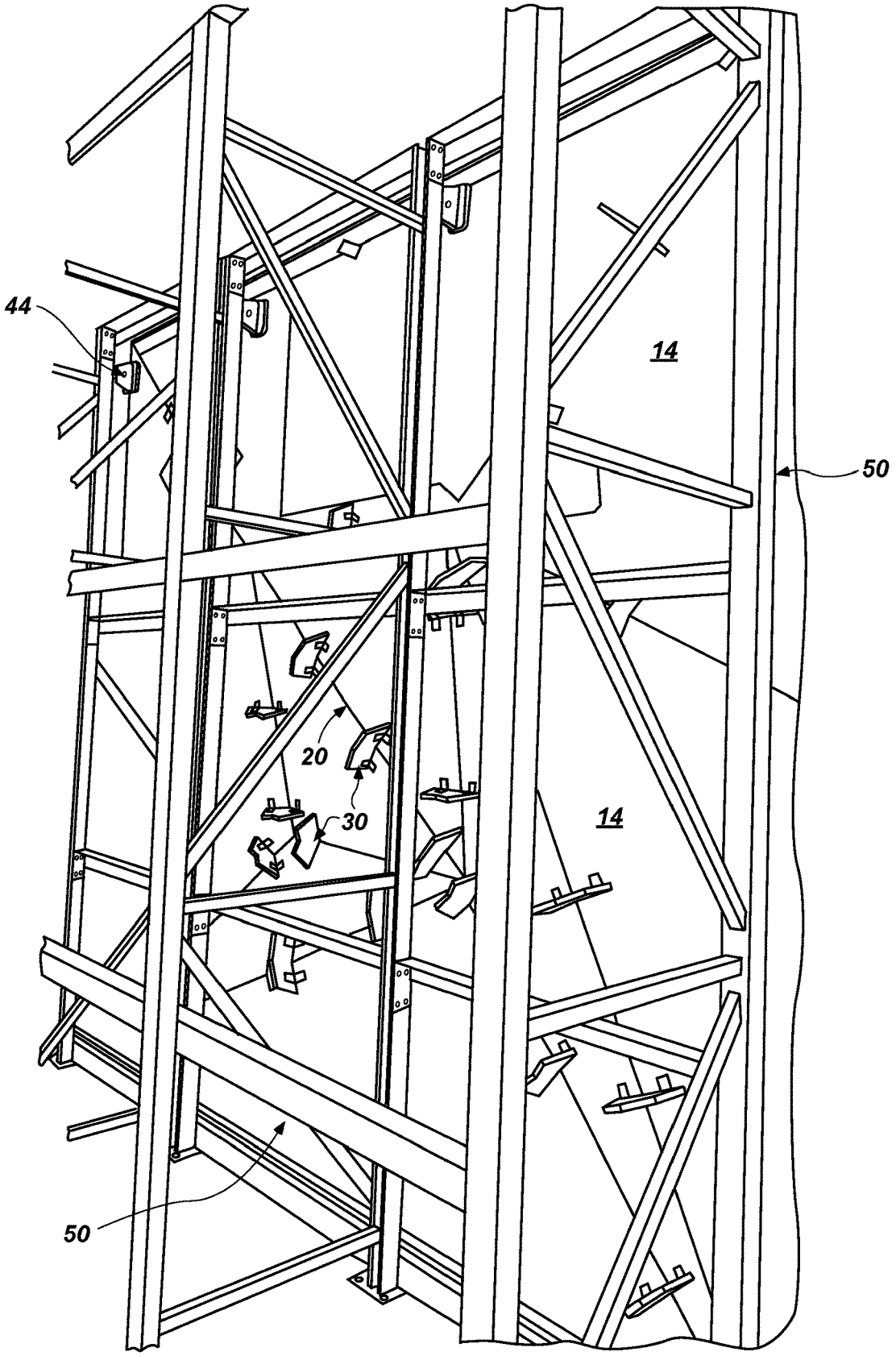
FIG. 9 is a perspective view of a scaffold and the back of a climbing wall.

Referring to FIG. 9, a support scaffold 50, or scaffold 50, may be utilized to support panels 14 during and after assembly or construction of a climbing wall 10. For example, a support brace 44 may be utilized to secure a panel 14 to a scaffold 50. As another example, a support brace 44 and a support arm 46 may be utilized to secure a panel 14 to a scaffold 50. A support scaffold 50 may be composed of any suitable material, including without limitation, wood, plastic, steel, and the like. A support scaffold 50 may be of any suitable configuration, including without limitation, rectangular, triangular, circular, and/or any suitable combination thereof. Generally, the shape and configuration of a scaffold 50 will approximate the shape and configuration of the corresponding wall 10.

In one embodiment, a support scaffold 50 may be thought of to include a "neutral plane," or reference point with respect to the scaffold 50 and panels 14. Such a neutral plane may be defined at the time the wall 10 is assembled. A neutral plane is generally parallel to the front of the scaffold 50.

Figure 10:
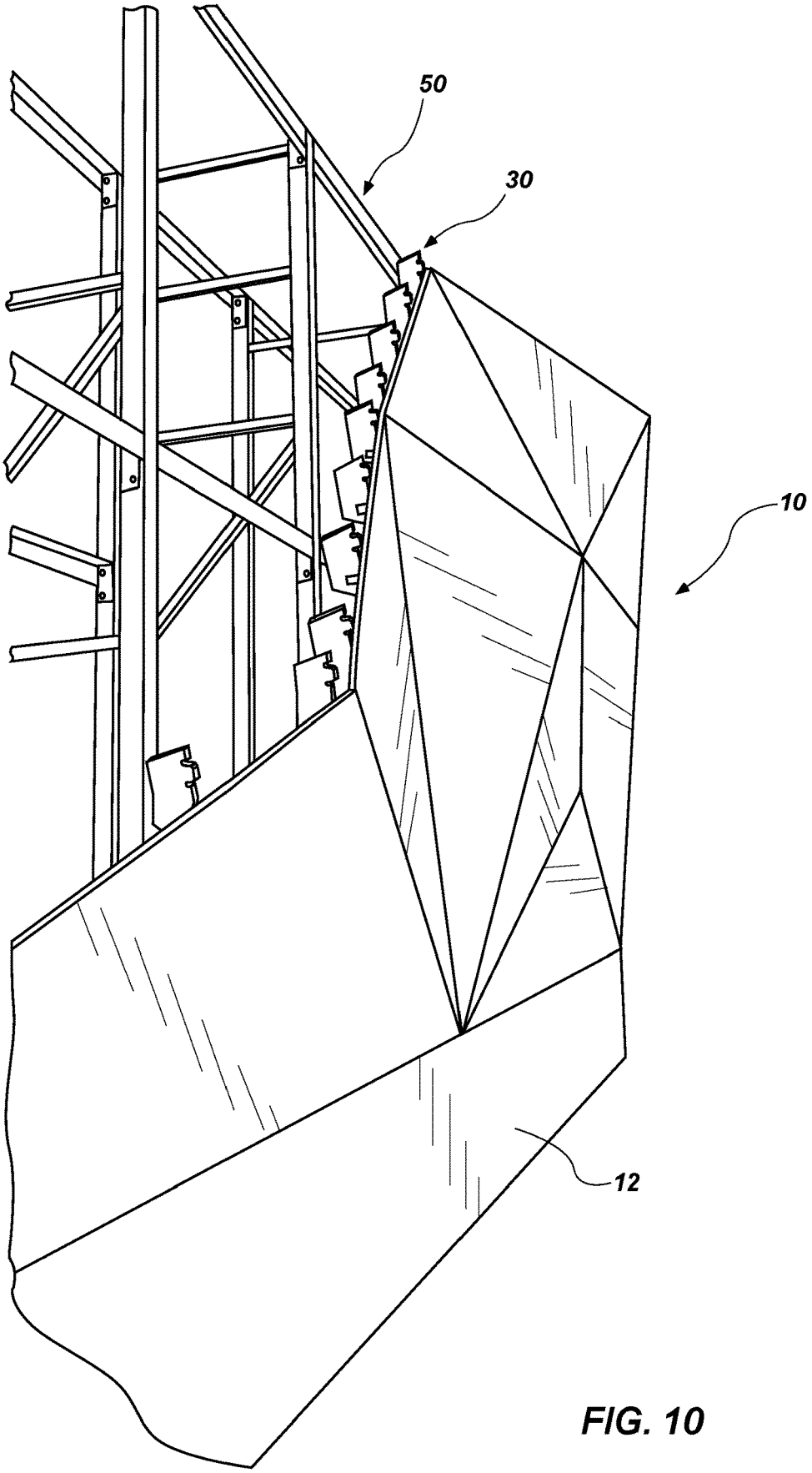
FIG. 10 is a perspective view of a scaffold and the front of a climbing wall.

Referring to FIG. 10, a support scaffold 50, or scaffold 50, may be utilized to support panels 14 and base panels 12 during and after assembly or construction of a climbing wall 10. Angle locks 30 may be utilized to hold together panels 14 and support panels 14 at a desired dihedral angle.

Figure 11:
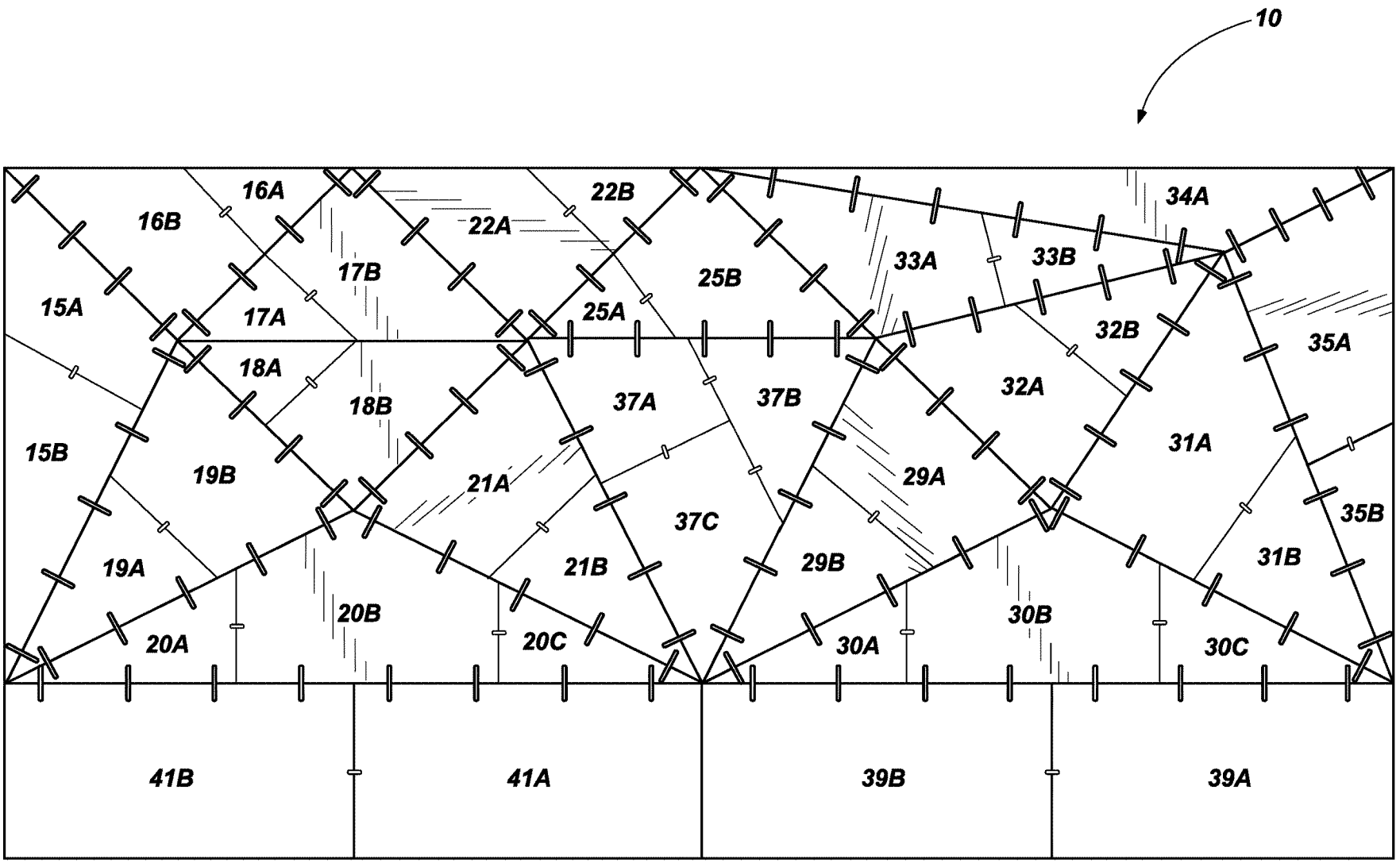
FIG. 11 is an example of a design or map for assembling a climbing wall.

Referring to FIG. 11, a climbing wall 10, or wall 10, may be assembled or constructed by utilizing a design map, or map, that shows the placement of individual panels. The design map of FIG. 11 is shown without item numbers (except for wall 10) to illustrate the use of panel labels without those panel labels being confused for item numbers. Individual panels 14 may include panel labels 22, or panel designations 22, that are shown on a design map. Thus, a design map may show the placement of each individual panel with respect to the other individual panels used to assemble or construct a wall 10. A design map may also show the placement of angle locks 30 to be used to secure panels to each other and hold adjacent panels at desired dihedral angles. A design map can be extremely helpful, even essential, in the proper assembly of a climbing wall 10.

Figure 12:
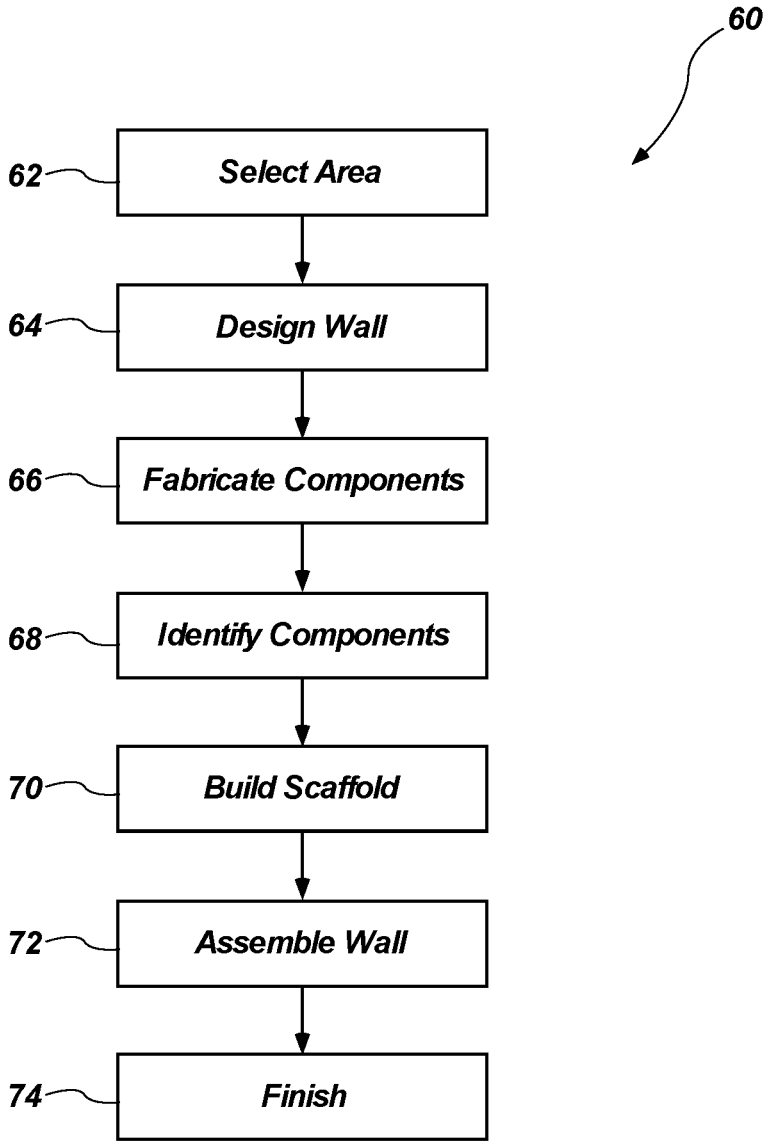
FIG. 12 is a chart illustrating a system or method for constructing a climbing wall.

Referring to FIG. 12, any suitable method 60, or system 60, may be utilized to plan and build a climbing wall 10. In one embodiment, a method 60 may be comprised of several steps, including without limitation, selecting an area 62 for a wall 10, designing 64 a wall, fabricating components 66 for a wall, identifying or labeling individual components 68 for a wall, building a scaffold 70 for a wall 10, assembling or constructing 72 a wall 10, and finishing 74 a wall 10.

A step of selecting an area 62 for a climbing wall 10 may include a number or considerations. For example, and not by way of limitation, a climbing wall 10 may be larger and stationary, or smaller and portable. A wall 10 may be intended for indoor or outdoor use. A wall 10 may come in a variety of sizes and shapes to fit a certain area or room. Other similar considerations may also apply.

A step of designing 64 a wall 10 may include a number of considerations. For example, and not by way of limitation, a wall 10 may be designed in a wide variety of shapes, sizes, and configurations. A wall 10 will generally have numerous contours, apexes, depressions, flat surfaces, and the like. A wall 10 may be designed to match or mimic a particular rock formation. A wall 10 may be designed for specific rock climbing challenges, techniques, and/or skills. A wall 10 may be designed for one level of rocking climbing skill, or for multiple levels of rock climbing skill.

The step of designing 64 a wall 10 may be accomplished with the help of a computer program that can place and account for the various contours of a wall, design and place various panels 14 to be used in a wall, assign panel labels 22 to specific panels 14, assign lock labels 40 to specific angle locks 30, and the like. Designing 64 may also include mapping a wall, or developing and printing a design map. Any suitable means and/or process can be utilized in mapping a wall and/or producing a design map that can be utilized to plan, fabricate, and/or assemble a wall.

A step of fabricating 66 component parts and pieces for a wall 10 may include a variety of considerations and tools. For example, and not by way of limitation, a CNC (computer numerical control) router and/or table may be used to cut the majority, if not all, of the panels 14. For example, and not by way of limitation, individual panels 14 may be fabricating using any suitable process and/or machinery that can produce the panels 14 that include at least the desired, appropriately placed grooves 28, appropriate panel curves 25, appropriate slope cuts 27, as well as the proper panel labels 22. For example, and not by way of limitation, individual angle locks 30 may be fabricated using any suitable process and/or machinery that can produce the angle locks 30 that include at least the desired, appropriately angled anterior surfaces 36, corresponding posterior surfaces 38, appropriate tabs 34, as well as the proper lock labels 40.

The step of fabricating 66 component parts may also include fabricating all the braces 32, support braces 44, support arms 46, and scaffold 50 components necessary to assemble a wall 10 in accordance with the designing 64 and mapping of the wall 10. The step of fabricating 66 component parts may include fabricating or obtaining any part or piece that may be required during the assembly 72 of the wall 10.

A step of identifying 68, or labeling 68, component parts and pieces for a wall 10 may include a number of considerations. For example, and not by way of limitation, each panel 14 may be labeled with a panel label 22 in accordance with the designing 64 or mapping of the wall 10. Similarly, each angle lock 30 may be labeled with a lock label 40 in accordance with the designing 64 or mapping of the wall 10. Generally, panels and angle locks may be identified with labels in a way the facilitates the placement and assembly of those panels and angle locks.

For example, and not by way of limitation, panel labels 22 for adjacent panels may include matching and/or corresponding alpha-numeric characters. Put another way, one panel 14 may have a panel label 22 of "85" while another panel 14 that will be adjacent to the first panel may have a panel label 22 of "86."

For example, and not by way of limitation, panel labels 22 may include alpha-numeric characters that match and/or correspond to alpha-numeric characters on lock labels 40 such that angle locks 30 that will be utilized with corresponding panels 14 can be readily identified. Put another way, one panel may have a panel label 22 of "85" while an angle lock 30 intended to be utilized with that panel may have a label lock 40 of "85" or "85A" (depending on the side of the angle lock 30 and corresponding tab 34 that goes with that panel).

The step of identifying 68, or labeling 68, component parts and pieces may be accomplished in any suitable manner, and most often, in accordance with the designing 64 or mapping of the wall 10.

A step of building 70 a support scaffold 50 may include a number of considerations. Generally, a support scaffold 50 may be built 70 or constructed in any suitable manner using any suitable or required tools and processes. For example, and not by way of limitation, a scaffold 50 may be built a piece at a time, or it may come with sections already completed. The size and configuration of a scaffold 50 may be built to match the size and configuration of the corresponding wall 10.

A step of assembling 72, or constructing 72, or securing 72, a wall 10 may include a number of considerations and processes and tools. Generally, any suitable means, processes, tools, and/or techniques may be utilized in the assembly 72 of a wall 10.

For example, and not by way of limitation, panels 14 may be assembled or secured so as to produce a number of dihedral angles of various types and degrees. Panels 14 may be assembled in a manner that produces a substantially seamless, or very smooth, joint 20. Angle locks 30 may be utilized to hold panels in place and to support the desired dihedral angles with respect to the panels 14.

The step of assembling 72 may also include securing the panels 14 to the scaffold 50 in any suitable manner and by any suitable means. For example, and not by way of limitation, support braces 44 and support arms 46 may be utilized to secure individual panels 14 to the scaffold 50.

A step of finishing 74 a wall 10 may include a number of considerations. For example, and not by way of limitation, finishing 74 a wall 10 may include painting a wall, covering a wall with some sort of texture or pattern, securing safety equipment at or near a wall, and/or the placing holds (not pictured) to facilitate climbing and scaling the wall 10. The step of finishing 74, and what type of finishing will be done, may further include considerations related to whether the wall will be outside or inside, what type of holds will be utilized, and the like.

In one embodiment, a method for constructing a climbing wall 10 may comprise selecting 62 a location for a wall 10, wherein the wall 10 comprises a plurality of panels 14, designing 64 a wall 10, wherein the designing 64 comprises mapping placement and angle of each panel 14 in the plurality of panels, fabricating 66 each panel 14 in the plurality of panels in accordance with the mapping and in a manner that results in each panel 14 having at least one edge the consists of a panel curve 25 and a slope angle 27*a*, identifying 68 each panel 14 in the plurality of panels in accordance with the mapping, building 70 a support scaffold 50 approximately the same size as the wall 10 at the location, and assembling 72 each panel 14 in the plurality of panels in accordance with the mapping and in a manner that results in the plurality of panels comprising at least three dihedral angles.

The method of constructing a climbing may 10 also comprise finishing 74 the wall, wherein the finishing 74 includes at least one of painting the plurality of panels 14, inserting holds into the wall 10, texturing the wall 10, and installing safety features with the wall 10. It may also comprise utilizing an angle lock 30 to secure at least two panels 14 to each other in the plurality of panels. It may also include securing at least one angle lock 30 to at least one panel 14 in the plurality of panels utilizing a lock brace 42.

In one embodiment, a method 60 for constructing a climbing wall 10 may comprise selecting 62 an area for a climbing wall 10, designing 64 a climbing wall 10, wherein the designing 64 further comprises mapping the placement and angle for a plurality of panels, fabricating 66 a first panel 14 that will form part of the plurality of panels in accordance with the mapping, wherein the first panel 14 comprises a first edge and the first edge consists of a first panel curve 25 and a first slope angle 27*a*, fabricating 66 a second panel 14 that will form part of the plurality of panels in accordance with the mapping, wherein the second panel 14 comprises a second edge and the second edge consists of a second panel curve 25 and a second slope angle 27*a*, fabricating an angle lock 30 comprising a desired angle and a first tab 34 and a second tab 34, and securing the first panel 14 and the second panel 14 to each other along the first edge and the second edge, respectively, wherein the securing comprises attaching the first tab 34 to the first panel 14 and the second tab 34 to the second panel 14 in a manner that utilizes the first panel curve 25 and the second panel curve 25 to produce the desired angle and a substantially seamless connection, or joint 20.

In one embodiment, a method for assembling a climbing wall 10 may further comprise building 70, before the securing 72, a support scaffold 50 at the area to provide support for the climbing wall 10. The method may further comprise fabricating 66 additional panels 14 that will form part of the plurality of panels in accordance with the mapping, wherein each additional panel 14 comprises at least one panel curve 25 and at least one slope angle 27*a*, fabricating 66 additional angle locks 30 comprising additional angles and additional tabs 34, and securing 72 the additional panels 14 utilizing the additional angle locks 30 to complete the climbing wall 10 in accordance with the mapping.

In one embodiment, a method 60 for constructing a climbing wall 10 may include a panel 14 further comprising at least one groove 28 positioned to receive a first tab 34 and a second panel 14 further comprising at least one groove 28 to receive a second tab 34. A method 60 may further comprise providing a lock brace 42, and securing the angle lock 30 to the first panel 14 using the lock brace 42. A method 60 may further comprise providing a support brace 44, and providing a support arm 46, and securing the support brace 44 to the first panel 14, and securing the support arm 46 to the support brace 44, and securing the support arm 46 to the support scaffold 50.

In one embodiment, a method 60 for constructing a climbing wall 10 may comprise selecting an area 62 for a climbing wall 10, and designing 64 a climbing wall 10, wherein the designing 64 further comprises mapping the placement and angle for a plurality of panels, and fabricating 66 a first panel 14 that will form part of the plurality of panels in accordance with the mapping, wherein the first panel 14 comprises a first edge and the first edge consists of a first panel curve 25 and a first slope angle 27*a*, and fabricating 66 a second panel 14 that will form part of the plurality of panels in accordance with the mapping, wherein the second panel 14 comprises a second edge and the second edge consists of a second panel curve 25 and a second slope angle 27*a*, fabricating 66 an angle lock 30 comprising a desired angle and a first tab 34 and a second tab 34, and building 70 a support scaffold 50 at the area to provide support for the climbing wall 10, and securing 72 the first panel 14 and the second panel 14 to each other along the first edge and the second edge, respectively, wherein the securing comprises attaching the first tab 34 to the first panel 14 and the second tab 34 to the second panel 14 in a manner that utilizes the first panel curve 25 and the second panel curve 25 to produce the desired angle and a substantially seamless connection.

In one embodiment, a method 60 may further comprise fabricating 66 additional panels 14 that will form part of the plurality of panels in accordance with the mapping, wherein each additional panel 14 comprises at least one panel curve 25 and at least one slope angle 27*a*, and fabricating 66 additional angle locks 30 comprising additional angles and additional tabs 34, and identifying 68 the additional panels 14 and the additional angle locks 30 in accordance with the mapping, and securing 72 the additional panels 14 utilizing the additional angle locks 30 in a manner that provides self-locking of the panels 14 if the panels 14 are pulled away from the angle locks 30, and completing the climbing wall 10 in accordance with the mapping and the identifying.

In one embodiment, a method may also include where the first panel 14 further comprises at least one groove 28 positioned to receive the first tab 34 and the second panel 14 further comprises at least one groove 28 to receive the second tab 34. A method may also include where the additional panels 14 further comprise at least one groove 28 positioned to receive an additional tab 34. A method may further comprise providing a lock brace 42, and securing the angle lock 30 to the first panel 14 using the lock brace 42. A method 60 may further comprise providing a support brace 44, and providing a support arm 46, and securing the support brace 44 to the first panel 14, and securing the support arm 46 to the support brace 44, and securing the support arm 46 to the support scaffold 50.

The present invention may be embodied in other specific forms and combinations without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method for constructing a climbing wall, comprising:
selecting an area for a climbing wall;
designing a climbing wall, wherein the designing further comprises mapping the placement and angle for a plurality of panels;
fabricating a first panel that will form part of the plurality of panels in accordance with the mapping, wherein the first panel comprises a first edge and the first edge consists of a first panel curve and a first slope angle;
fabricating a second panel that will form part of the plurality of panels in accordance with the mapping, wherein the second panel comprises a second edge and the second edge consists of a second panel curve and a second slope angle;
fabricating an angle lock comprising a desired angle and a first tab and a second tab wherein the first panel further comprises at least one groove positioned to receive the first tab and the second panel further comprises at least one groove to receive the second tab; and
securing the first panel and the second panel to each other along the first edge and the second edge, respectively, wherein the securing comprises attaching the first tab to the first panel and the second tab to the second panel in a manner that utilizes the first panel curve and the second panel curve to produce the desired angle and a substantially seamless connection.

2. The method of claim 1, further comprising:
building, before the securing, a support scaffold at the area to provide support for the climbing wall.

3. The method of claim 2, further comprising:
fabricating additional panels that will form part of the plurality of panels in accordance with the mapping, wherein each additional panel comprises at least one panel curve and at least one slope angle;
fabricating additional angle locks comprising additional angles and additional tabs; and
securing the additional panels utilizing the additional angle locks in a manner that provides self-locking of the panels if the panels are pulled away from the angle locks.

4. The method of claim 3, further comprising:
providing a support brace;
providing a support arm;
securing the support brace to the first panel;
securing the support arm to the support brace; and
securing the support arm to the support scaffold.

5. The method of claim 1, further comprising:
providing a lock brace; and
securing the angle lock to the first panel using the lock brace.

6. A method for constructing a climbing wall, comprising:
selecting an area for a climbing wall;
designing a climbing wall, wherein the designing further comprises mapping the placement and angle for a plurality of panels;
fabricating a first panel that will form part of the plurality of panels in accordance with the mapping, wherein the first panel comprises a first edge and the first edge consists of a first panel curve and a first slope angle;
fabricating a second panel that will form part of the plurality of panels in accordance with the mapping, wherein the second panel comprises a second edge and the second edge consists of a second panel curve and a second slope angle;
fabricating an angle lock comprising a desired angle and a first tab and a second tab wherein the first panel further comprises at least one groove positioned to receive the first tab and the second panel further comprises at least one groove to receive the second tab;
building a support scaffold at the area to provide support for the climbing wall; and
securing the first panel and the second panel to each other along the first edge and the second edge, respectively, wherein the securing comprises attaching the first tab to the first panel and the second tab to the second panel in a manner that utilizes the first panel curve and the second panel curve to produce the desired angle and a substantially seamless connection.

7. The method of claim 6, further comprising:

fabricating additional panels that will form part of the plurality of panels in accordance with the mapping, wherein each additional panel comprises at least one panel curve and at least one slope angle;

fabricating additional angle locks comprising additional angles and additional tabs;

identifying the additional panels and the additional angle locks in accordance with the mapping; and securing the additional panels utilizing the additional angle locks in a manner that provides self-locking of the panels if the panels are pulled away from the angle locks; and completing the climbing wall in accordance with the mapping and the identifying.

8. The method of claim 7, wherein the additional panels further comprise at least one groove positioned to receive an additional tab.

9. The method of claim 8, further comprising:

providing a support brace;

providing a support arm;

securing the support brace to the first panel;

securing the support arm to the support brace; and securing the support arm to the support scaffold.

10. The method of claim 8, further comprising:

providing a lock brace; and securing at least one additional angle lock to at least one additional panel utilizing the lock brace.

11. The method of claim 10, further comprising:

providing a support brace;

providing a support arm;

securing the support brace to at least one additional panel;

securing the support arm to the support brace; and securing the support arm to the support scaffold.

12. The method of claim 6, further comprising:

providing a lock brace; and securing the angle lock to the first panel using the lock brace.

* * * * *